US011957223B2

(12) United States Patent
Hoodecheck et al.

(10) Patent No.: US 11,957,223 B2
(45) Date of Patent: Apr. 16, 2024

(54) ADJUSTABLE GRIP SYSTEM FOR TREKKING POLES AND THE LIKE

(71) Applicant: Hoodco, Inc., Lone Tree, CO (US)

(72) Inventors: Stephen C. Hoodecheck, Lone Tree, CO (US); Scott Noble, Denver, CO (US)

(73) Assignee: Hoodco, Inc., Lone Tree, CO (US)

( * ) Notice: Subject to any disclaimer, the term of this patent is extended or adjusted under 35 U.S.C. 154(b) by 149 days.

(21) Appl. No.: 17/729,571

(22) Filed: Apr. 26, 2022

(65) Prior Publication Data

US 2023/0090070 A1 Mar. 23, 2023

Related U.S. Application Data

(60) Provisional application No. 63/246,947, filed on Sep. 22, 2021.

(51) Int. Cl.
*A63C 11/22* (2006.01)
*A45B 9/02* (2006.01)

(52) U.S. Cl.
CPC ..... *A45B 9/02* (2013.01); *A63C 11/222* (2013.01)

(58) Field of Classification Search
CPC ..... A45B 9/02; A63C 11/222
USPC ..... 280/821; 135/72
See application file for complete search history.

(56) References Cited

U.S. PATENT DOCUMENTS

| | | | | |
|---|---|---|---|---|
| 4,448,442 | A * | 5/1984 | Weber-Henning | A63C 11/221 280/823 |
| 4,597,589 | A | 7/1986 | Fujii et al. | |
| 5,287,870 | A | 2/1994 | Rhodes | |
| 5,441,307 | A * | 8/1995 | Quintana | F16B 2/185 24/270 |
| 6,070,907 | A * | 6/2000 | Bujold | A63C 11/22 135/65 |
| 6,082,767 | A * | 7/2000 | Bujold | A63C 11/22 135/84 |
| 6,142,527 | A * | 11/2000 | Lenhart | A63C 11/221 135/74 |
| 6,203,063 | B1 * | 3/2001 | Bujold | A63C 11/22 403/57 |
| 6,491,323 | B1 | 12/2002 | Kustritz | |
| 6,644,328 | B1 | 11/2003 | Lenhart | |
| 6,755,440 | B1 | 6/2004 | Jones | |
| 8,496,018 | B2 | 7/2013 | Lenhart et al. | |
| 8,579,329 | B2 * | 11/2013 | Lenhart | A63C 11/2224 280/821 |
| 10,722,010 | B2 | 7/2020 | D'Jay | |
| 2010/0154850 | A1 | 6/2010 | Schulz et al. | |
| 2012/0015785 | A1 | 1/2012 | Burroughs | |

(Continued)

FOREIGN PATENT DOCUMENTS

| | | | |
|---|---|---|---|
| DE | 8702756 | U1 | 4/1987 |
| DE | 4440343 | A1 | 5/1996 |

(Continued)

*Primary Examiner* — Robert Canfield
(74) *Attorney, Agent, or Firm* — Kubota & Basol LLP

(57) ABSTRACT

An adjustable grip system configured for attachment to a pole which is intended for recreational or ambulatory use. The adjustable grip system provides adjustability of a grip in relation to longitudinal axis wherein the grip is adjustable in up to 3-degrees of freedom in relation to the pole portion and affixable in place once adjusted to the desired configuration.

19 Claims, 16 Drawing Sheets

(56) References Cited

U.S. PATENT DOCUMENTS

| | | | |
|---|---|---|---|
| 2016/0310827 | A1 | 10/2016 | Spataro et al. |
| 2016/0316869 | A1 | 11/2016 | Byrd et al. |

FOREIGN PATENT DOCUMENTS

| | | | | |
|---|---|---|---|---|
| JP | 06246030 | A | * | 9/1994 |
| KR | 20020036449 | A | | 5/2002 |

* cited by examiner

SECTION G-G

SECTION G-G

SECTION F-F

ADJUSTABLE GRIP SYSTEM FOR TREKKING POLES AND THE LIKE

This application claims the benefit of U.S. Provisional Patent Application 63/246,947 entitled "Adjustable Grip System for Trekking Poles and the Like" filed on Sep. 22, 2021, the entire contents of which are incorporated herein by reference in its entirety for all purposes.

FIELD OF THE INVENTION

An adjustable grip system configured for attachment to a pole, and is intended for recreational or ambulatory use providing adjustability of a grip in relation to longitudinal axis wherein the grip is adjustable in up to 3-degrees of freedom in relation to the pole portion and affixable in place once adjusted to the desired configuration.

BACKGROUND OF THE INVENTION

The use of recreational poles, such as ski poles or trekking poles, span a number of activities such as skiing, hiking, and snowshoeing. In skiing for instance, the pole is a quintessential portion of the skiers gear and is instrumental to the balance and performance of a skier. In hiking and snowshoeing, poles are more-so seen as an optional piece of gear which—while not required—can provide users with increased balance and control, and decreased fatigue and chance of injury.

Poles are typically sold for one intended purpose such as for skiing or for hiking/trekking. However, most poles consist of simply a shaft sized in relation to the height of the user, with a handgrip interconnected to a first end of the pole, and a ground interfacing element interconnected to the second end of the pole.

Some poles provide an adjustable overall length to accommodate different activities and different height users, however the rapid adjustability of orientation of the handle is not accounted for.

SUMMARY OF THE INVENTION

It is an aspect of the present invention to provide a rapid adjustability of the orientation of the grip in relation to the pole. In certain embodiments a ball and socket joint which allows adjustability of the grip in relation to the axis of the pole of angles up to 90 degrees from the longitudinal axis, allowing a user to use the trekking pole in a variety of uses including skiing, walking, snowshoeing. The adjustable grip system of the present invention further allows for the use of a trekking pole in a configuration resembling a cane or crutch as needed for walking comfort or in emergency scenarios.

In certain embodiments, the ball and socket joint of certain embodiments comprises an angle guide which provides mechanical stops angularly displaced from the longitudinal axis to allow a user to rapidly position the grip of the pole to a predetermined angle of their choosing. For instance, an opening of certain embodiments comprises channels which provide mechanical stops at preset angles such as 10 degrees, 20 degrees, and 30 degrees, and 90 degrees from the longitudinal axis.

It is an aspect of the present invention to maximize adjustability of a grip in relation to a longitudinal axis. In certain embodiments, the adjustability of the grip in relation to a longitudinal axis is accomplished through the use of a ball and socket joint which provides up to 3 degrees of freedom of adjustability.

It is an aspect of the present invention to prevent movement of the grip once adjusted to a desired angle from the longitudinal axis of the pole to which it is attached. In certain embodiments, gripping mechanisms are augmented for increased grip through the use of elements such as frictional holds, pin detents in the socket aspect which interface with dimples, or facets in the external aspect of the spheroid shape which are configured to engage with features within the socket portion of the ball and socket joint.

Certain embodiments of the invention disclosed herein surround an adjustable grip system for interconnection with a pole or shaft, such as a trekking pole, to allow a user to adjust the position of the grip in relation to the pole to a desired and/or optimal configuration for the intended use. In certain embodiments, a user is able to make such adjustments without the use of tools. In certain embodiments a user is able to adjustably reconfigure the grip in relation to the pole in at least 3 degrees of freedom corresponding to rotational movement around the x, y, and z axes.

It will be appreciated that a typical trekking pole comprises a linear shaft which is intended to be used vertically, and while a grip may have an intended manner in which a user should grasp the grip, the rotation of the shaft of the pole is inconsequential to its functionality.

In certain embodiments, the adjustable grip system incorporates a pinned joint about an axis which is typically horizontal when the trekking pole is held in a vertical manner for the pitch of the handle forward and backward, and the grip allows for axial adjustability rotating about the longitudinal axis of the grip. Due to the uniaxial nature of the pole shaft being able to be used in any configuration, the adjustment of the forward pitch of the grip, and the axial rotation of the grip results in the ability to adjust the grip configuration of the system in 3-degrees of freedom through the rotation about 2 axes. It is an aspect of the present invention to provide 3 degrees or more of adjustability through the adjustable rotation of the grip about 2 axes of rotation.

It is a further aspect of the present invention that the adjustable grip system of the present invention is configured to interconnect with poles having differing diameters.

It is an aspect of certain embodiments to provide three degrees of freedom of adjustability wherein a first portion and a second portion are interconnected at a joint which provides articulating rotation about a first axis. A grip is interconnected to a third portion which is slidably interconnected to the second portion about a second axis, such that the rotational position of the grip is adjustable in relation to the second portion.

In certain embodiments of the present invention, a joint interconnects a first portion and a second portion of an adjustable grip system wherein the joint in a normal state is in locked configuration constraining the rotation of the second portion in relation to the first portion. Upon disengaging a first locking mechanism, the joint is able to move freely and allows the rotational motion of the second portion in relation to the first portion.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

BRIEF DESCRIPTION OF THE DRAWINGS

FIG. 1B—A front view of certain embodiments of the present invention

FIG. 1C—A side section view of the embodiments of the present invention shown in FIG. 1B FIG. 2— A bottom view of certain embodiments of the present invention FIG. 3A—A front view of certain embodiments of the present invention FIG. 3B—A side section view of certain embodiments of the present invention shown in FIG. 3A FIG. 4A—A front view of certain embodiments of the present invention FIG. 4B—A side section view of certain embodiments of the present invention shown in FIG. 4A FIG. 5— An exploded perspective view of certain embodiments of the present invention

DETAILED DESCRIPTION OF VARIOUS EMBODIMENTS

Figure 1A:
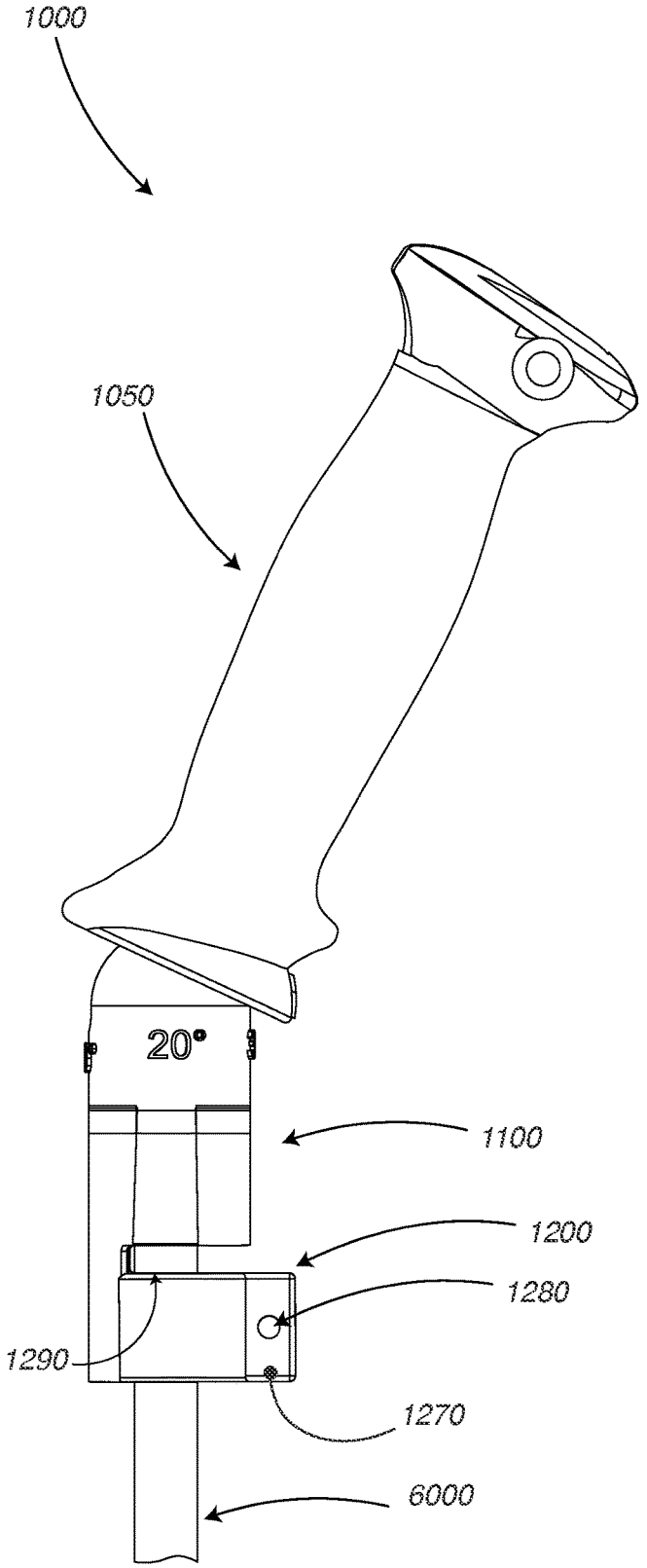
FIG. 1A—A side view of certain embodiments of the present invention
Figure 1B:
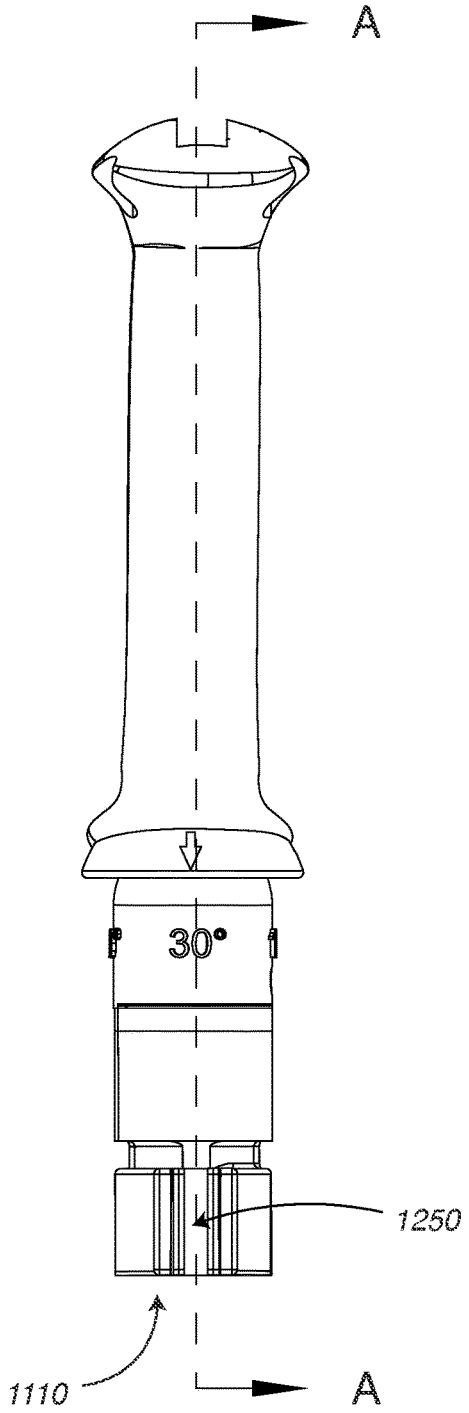
Figure 1C:
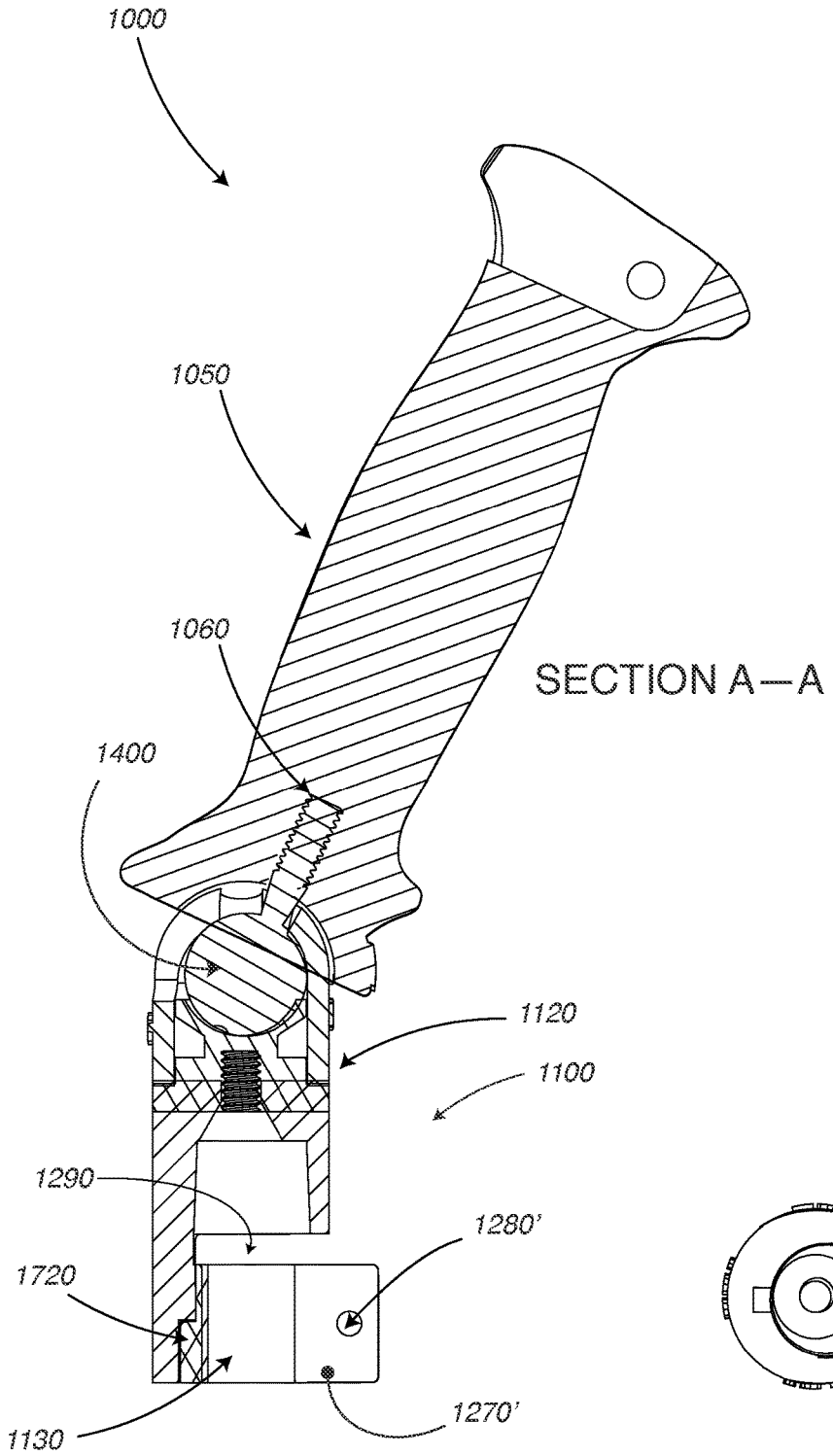
Figure 2:
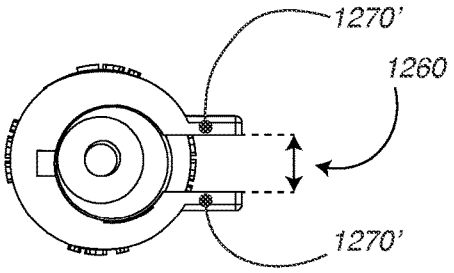
Figure 3A:
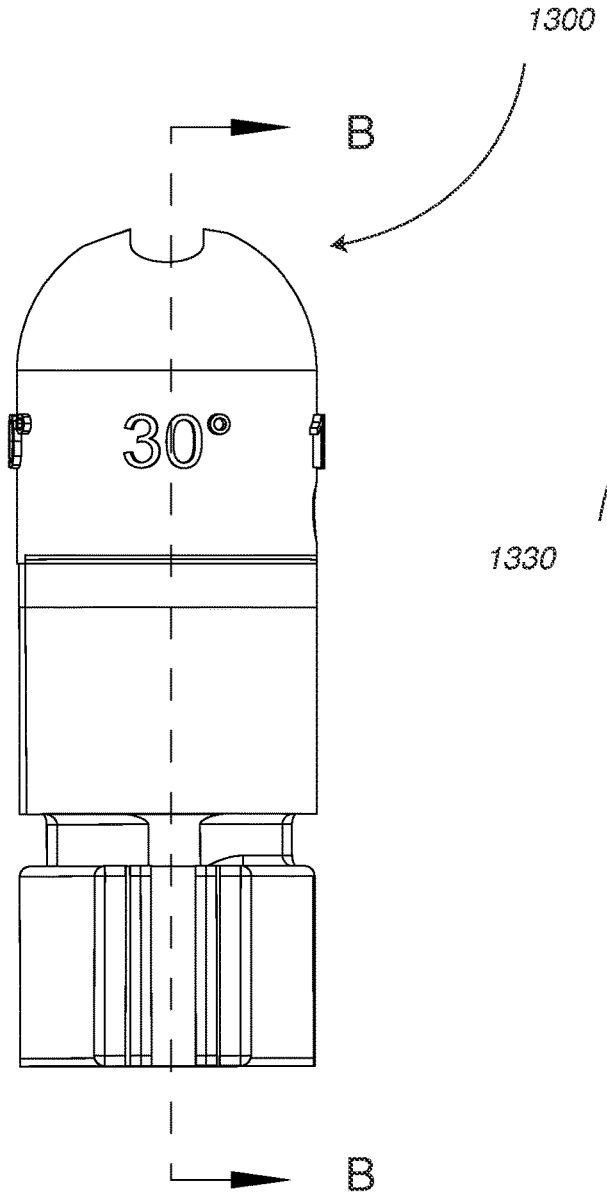
Figure 3B:
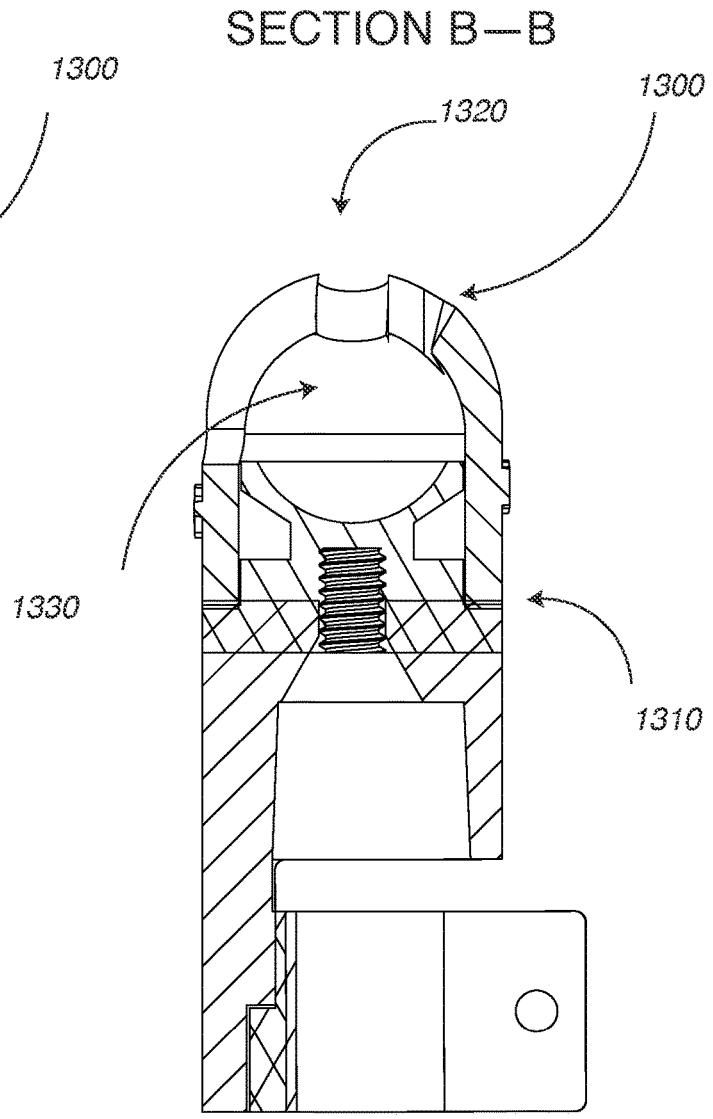

Certain embodiments of the present invention disclosed herein, shown in FIG. 1A-FIG. 2, comprise an adjustable grip system 1000 which permits the adjustability of a grip 1050 attached thereto. comprising a sleeve 1100 configured to interconnect with a shaft 6000 of a pole. The sleeve 1100 comprises a hollow aspect 1130 having a cylindrical form wherein the shaft of the pole 6000 can be inserted therein to interconnect with the sleeve 1100 by inserting the pole 6000 into the first end 1110 of the sleeve. The sleeve further comprises a clamp 1200 interconnected with a first end of the sleeve, wherein the clamp 1200 is configured to constrict the hollow aspect 1130 of the sleeve radially inward, thereby constraining the pole 6000 within the sleeve. In certain embodiments the clamp 1200 is interconnected to the first end 1110 of the sleeve and the sleeve comprises a longitudinal split 1250 having a width 1260 which extends the longitudinal length 1210 of the clamp. The longitudinal split 1250 allows the constriction of the clamp 1200.

In certain embodiments comprising a clamp 1200, the clamp further comprises a first tab 1270 and a second tab 1270' interconnected to the clamp on either side of the longitudinal split 1250. Drawing the tabs together, reduces the width 1260 of the longitudinal split 1250 of the clamp and constricts the clamp inward to affix it to a pole 6000. As shown, the tabs comprise coaligned apertures 1280, 1280' which allow for the insertion of threaded hardware or other mechanical fasteners to further enable the drawing of the first tab 1270 toward the second tab 1270'. It will be appreciated that the clamp interconnected to the first end of the sleeve can be constricted through a number of strategies known to those skilled in the art including draw latches, and threaded hardware.

In certain embodiments, referencing FIG. 1A-FIG. 2, wherein a sleeve comprises a clamp 1200, the clamp 1200 is integral to the sleeve 1100 wherein the clamp 1200 is able to constrict without constricting the sleeve 1100. Lateral relief cuts 1290 around a portion of the circumference 1140 of the sleeve allow the clamp 1200 to constrict independently of the sleeve 1100 while interconnected to the sleeve.

Figure 4A:
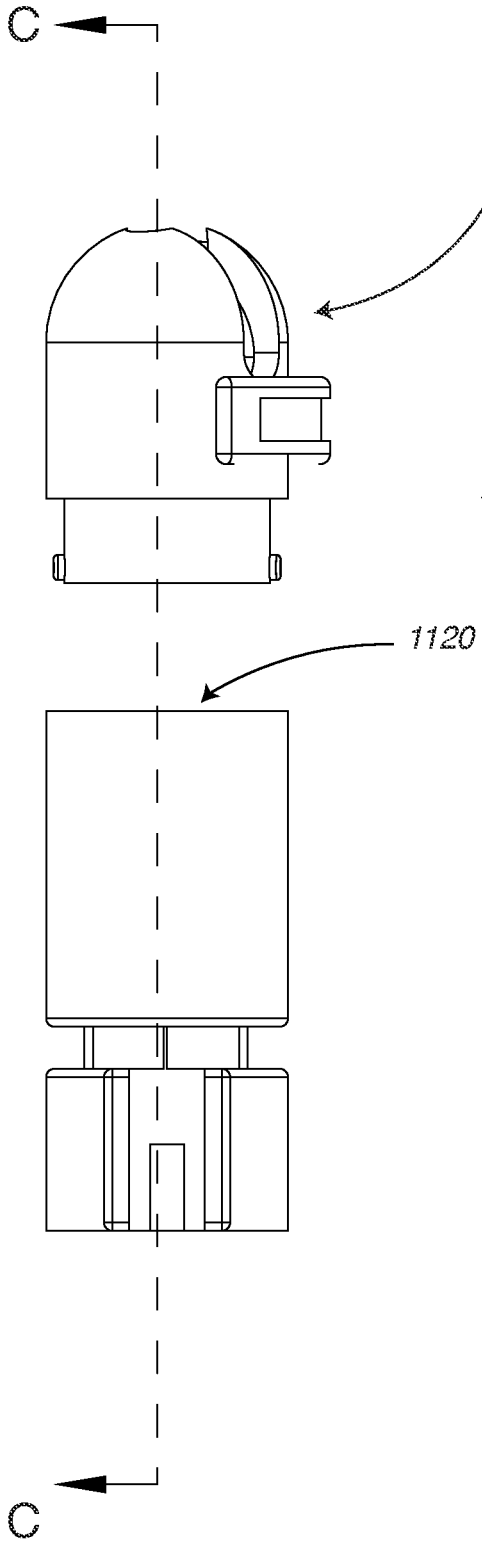
Figure 4B:
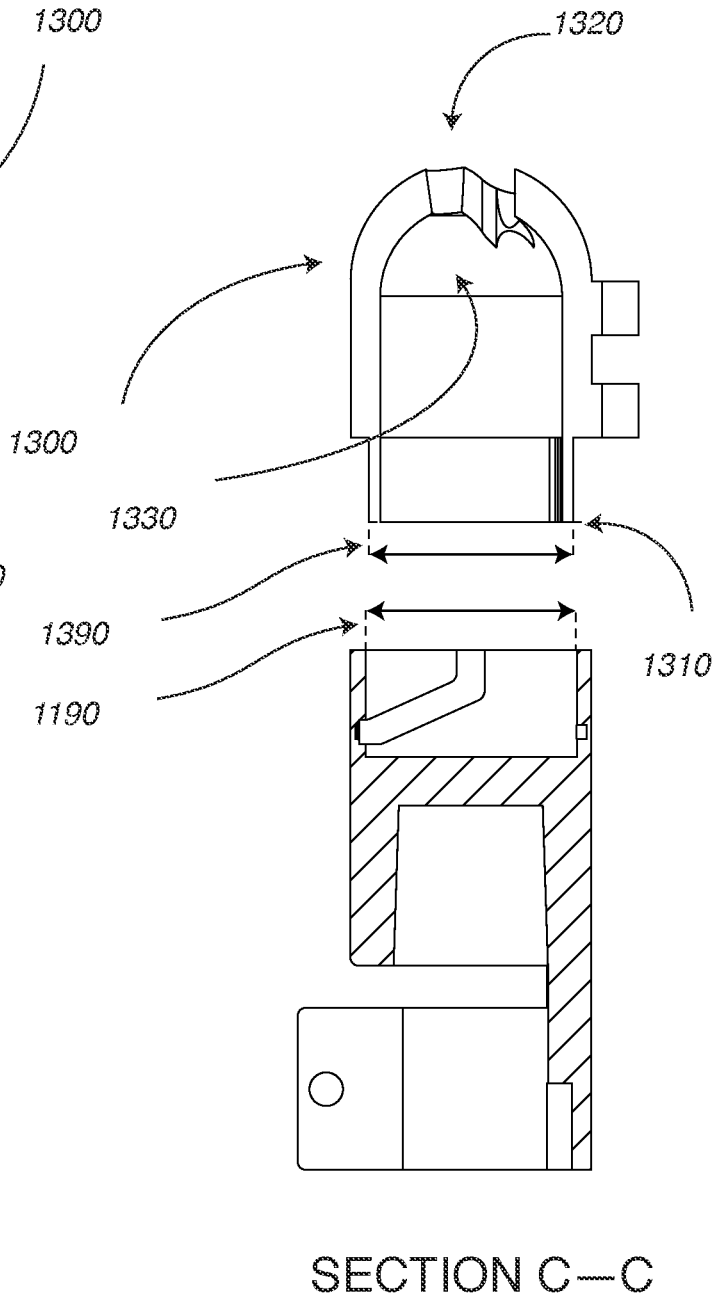

Certain embodiments, shown in FIG. 3A-FIG. 4B comprise a cap 1300 having a hollow aspect wherein the cap 1300 comprises a cylindrical first end 1310 configured to interconnect with the cylindrical second end 1120 of the sleeve, and a second end 1320 comprising a hemispherically shaped internal surface 1330 wherein the second end 1320 is configured to receive a spheroid 1400 (FIG. 1C) therein. The cap 1300 of certain embodiments, such as shown in FIG. 4A-4B, is configured to be releasably interconnectable to the sleeve.

Figure 5:
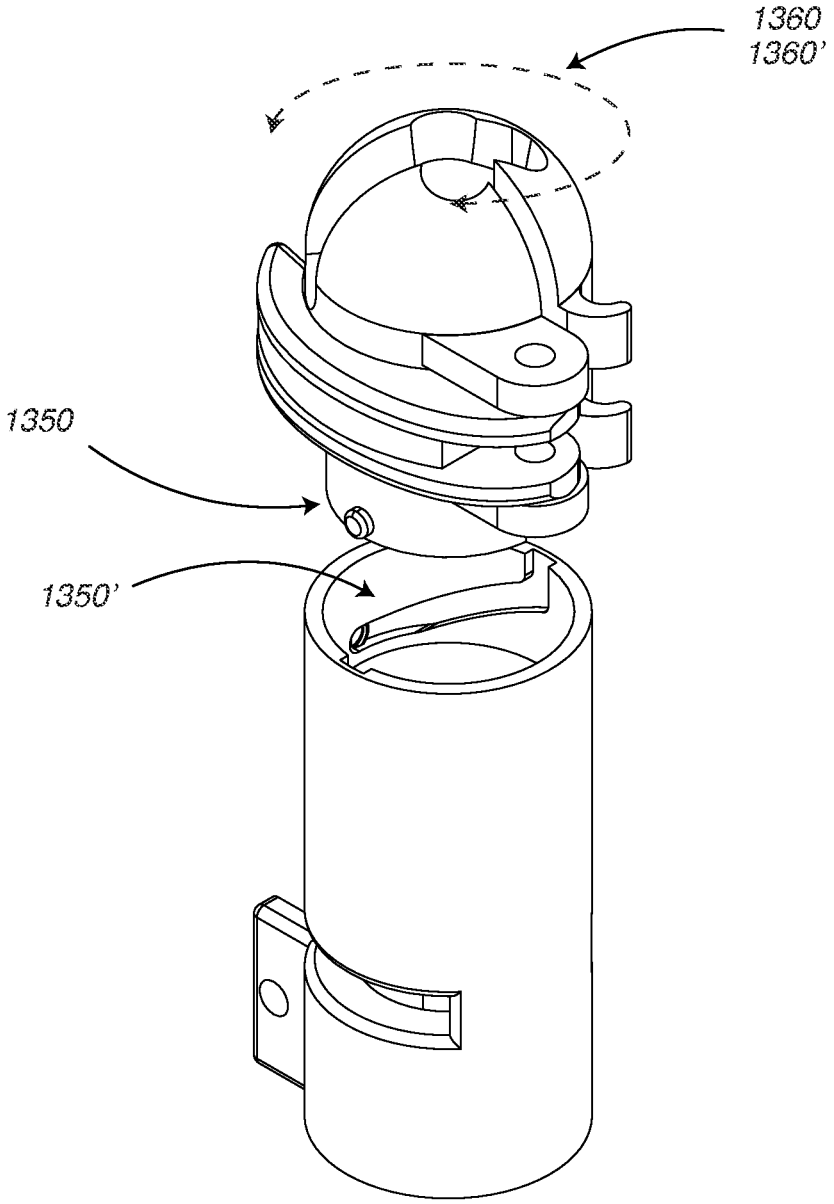

As shown in FIG. 4A-FIG. 5, the cylindrical first end 1310 of the cap has an external diameter 1390 less than then the internal diameter 1190 of the cylindrical second end of the sleeve wherein the first end of the cap is configured to insert within the second end of the sleeve. In certain embodiments, the cap is interconnected to the sleeve using a bayonet mount 1350, 1350' wherein twisting 1360 of the cap 1300 in a first direction relation to the sleeve 1100 locks the cap to the sleeve, and twisting 1360' of the cap 1300 in a second direction, opposite to the first direction, unlocks the cap 1300 from the sleeve 1100.

In certain embodiments, such as shown FIG. 6A-FIG. 6B, in a cap 1300 is configured to receive a spheroid 1400 which comprises a stud 1410 which extends radially outward from the spheroid. The stud 1410 comprises threading 1420 wherein a grip 1050 can be attached thereto. The stud 1410 extends out from an opening 1500 in the second end of the cap 1320 such that a female threaded feature 1060 (FIG. 1C) of the grip can be interconnected to the spheroid 1400 using the stud 1410. It will be appreciated that while embodiments shown comprise a threaded stud, alternative attachment methods of interconnecting a grip with the spheroid are within the spirit and scope of the present invention. These alternative connections include, but are not limited to a female threaded hole within the spheroid wherein the grip comprises a male threaded stud configured to mate with the female threaded feature, pinned connections, or other connections appreciated by one skilled in the art.

Figure 6:
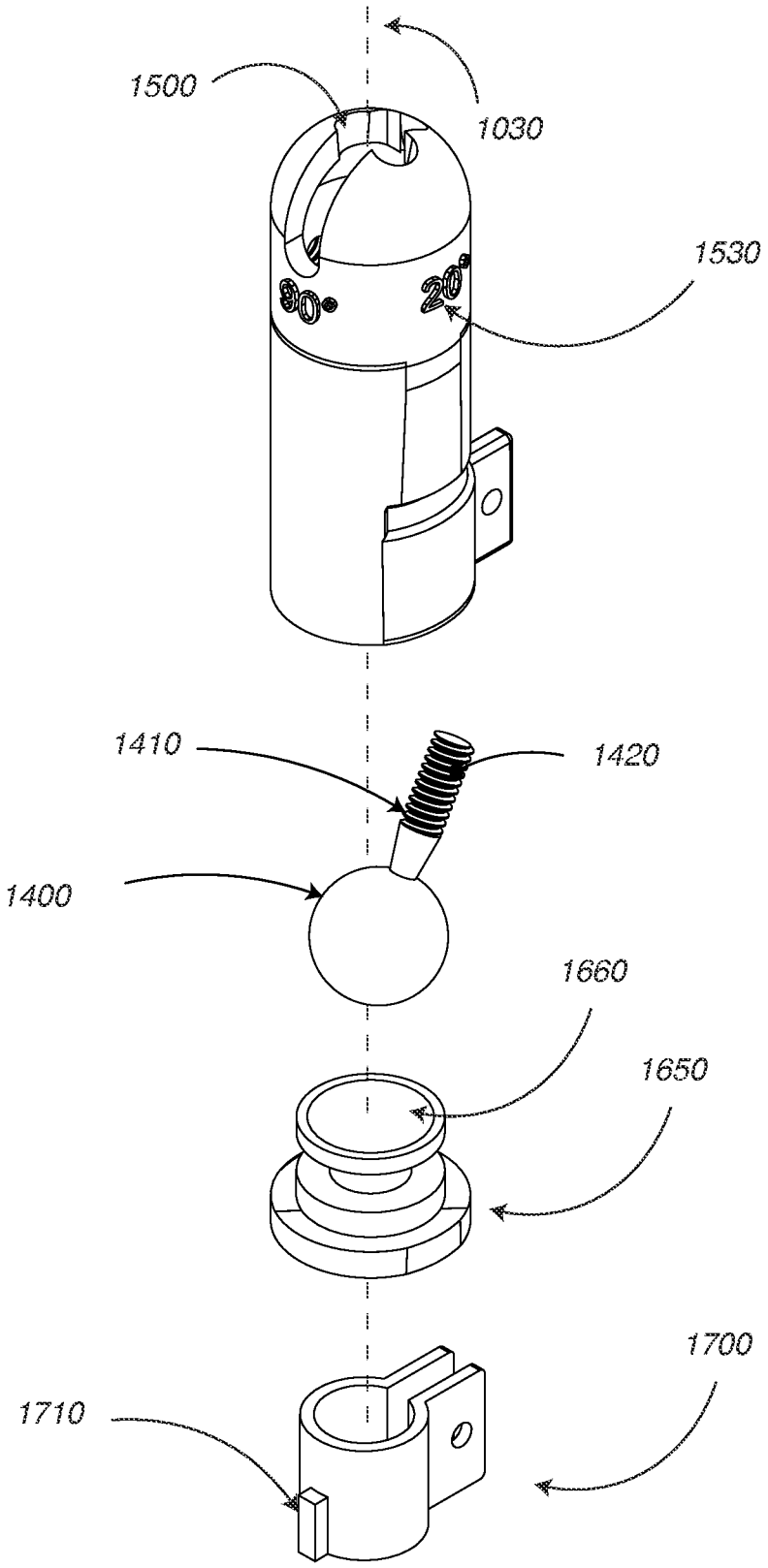
FIG. 6— An exploded perspective view of certain embodiments of the present invention
Figure 7:
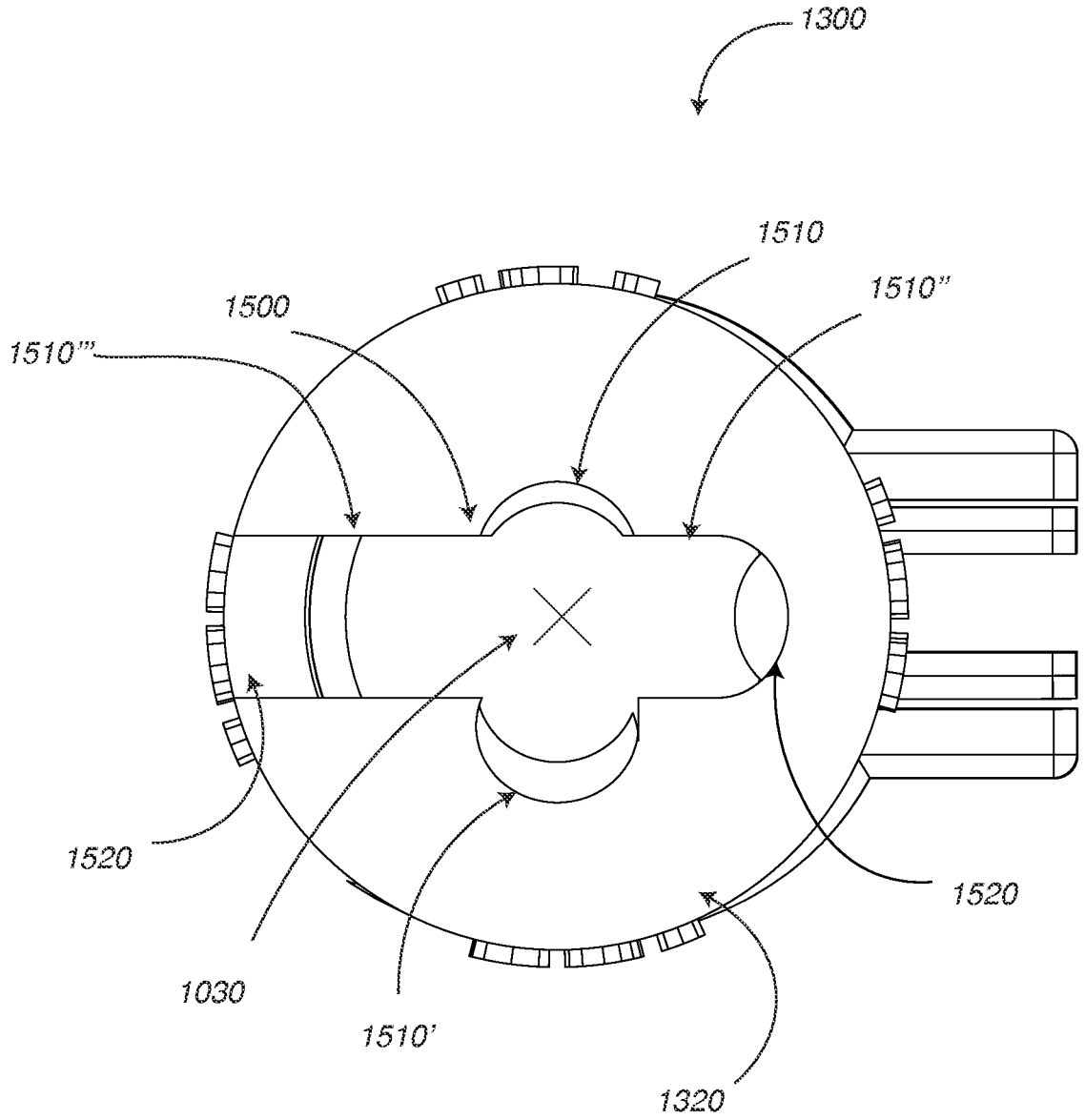
FIG. 7— A top view of certain embodiments of the present invention FIG. 8A—A side view of certain embodiments of the present invention FIG. 8B—A perspective view of certain embodiments of the present invention FIG. 8C—A top view of certain embodiments of the present invention FIG. 9A—A perspective view of certain embodiments of the present invention FIG. 9B—A perspective view of certain embodiments of the present invention FIG. 10A—A side view of certain embodiments of the present invention FIG. 10B—A front view of certain embodiments of the present invention FIG. 11A—A side view of certain embodiments of the present invention FIG. 11B—A front view of certain embodiments of the present invention FIG. 11C—A side section-view of certain embodiments of the present invention as shown in FIG. 11B FIG. 12A— An exploded perspective view of certain embodiments of the present invention

In certain embodiments, shown in FIG. 6-FIG. 7, the cap comprises a second end 1320 having an opening 1500 extending through the second end of the cap. The opening 1500 coincides with the longitudinal axis 1030 and comprises at least one channel 1510 which extends angularly away from the longitudinal axis 1030. The channel 1510 is configured such that the distal end 1520 of the channel is provides a mechanical stop for the stud 1410 of the spheroid. The mechanical stop is configured to dispose the stud 1410 at a predetermined angle, thereby disposing the grip attached thereto at the predetermined angle from the longitudinal axis 1030. In certain embodiments, an opening comprises a plurality of channels such as shown in FIG. 7 wherein the channels are angularly offset from each other. As shown the channels are angularly offset at 90 degrees from each other, however embodiments of the present invention are not limited thereto. In the example as shown in FIG. 7, the opening 1500 comprises four channels 1510 extending angularly outward wherein the channels 1510 are orthogonal to each other extending away from the longitudinal axis 1030. In certain embodiments a first channel 1510 provides a mechanical stop at 10 degrees from the longitudinal axis 1030, a second channel 1510' provides a mechanical stop at 20 degrees from the longitudinal axis, a third channel 1510" provides a mechanical stop at 30 degrees from the longitudinal axis, and a fourth channel 1510''' provides a mechanical stop at 90 degrees from the longitudinal axis. Although embodiments disclosed herein disclose mechanical stop angles of 10 degrees, 20 degrees, 30 degrees, and 90 degrees, embodiments comprising mechanical stops at alternate angles are within the spirit and scope of the present invention. In certain embodiments, referencing FIG. 6, the angle of mechanical stop provided by a channel is designated visibly 1530 on the external surface of the cap 1300.

Figure 8A:
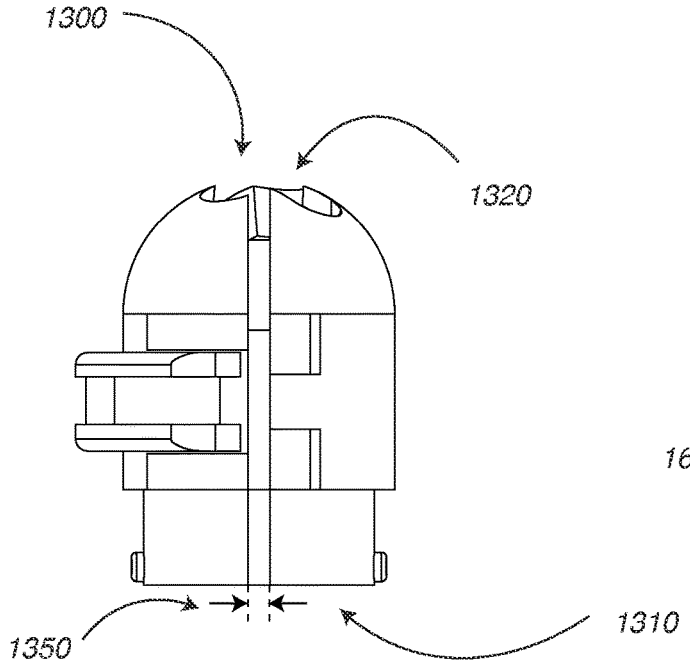
Figure 8B:
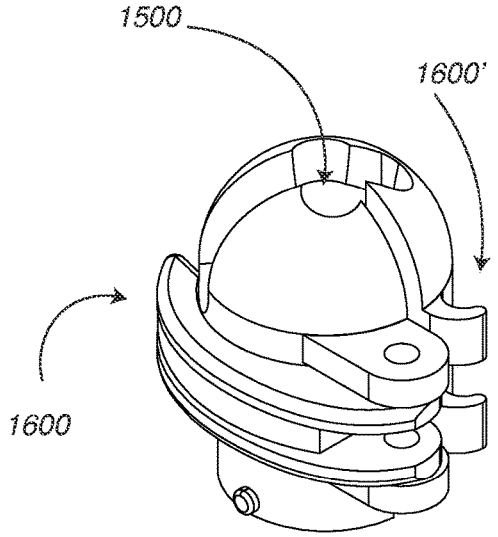
Figure 8C:
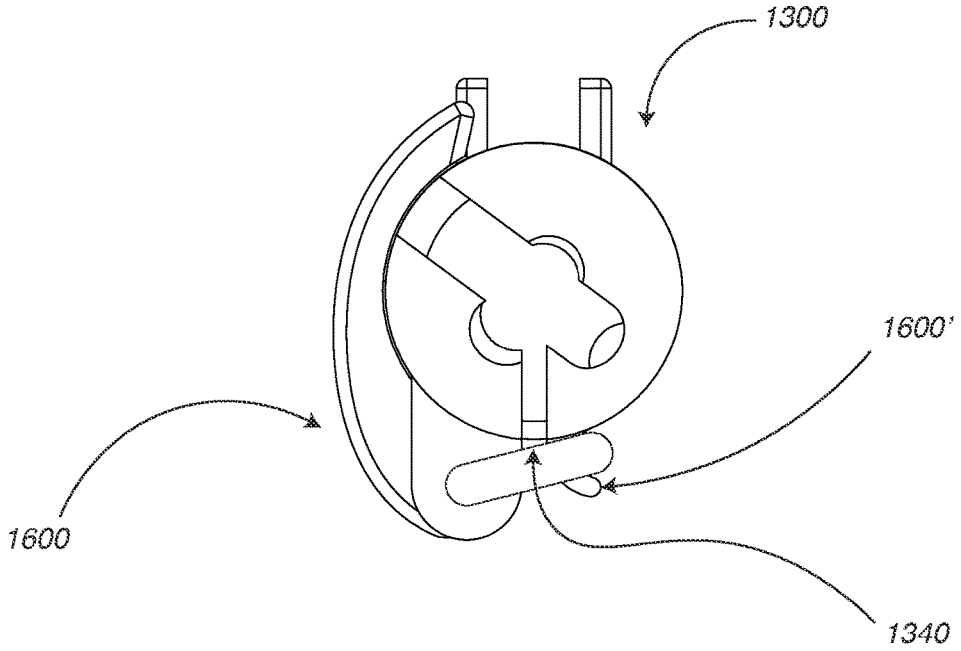

In certain embodiments, for example as shown in FIG. 8A-FIG. 8C, the cap 1300 comprises a longitudinal split 1340 extending through the thickness of the cap 1300 wherein the longitudinal split 1340 extends from the second end of the cap wherein it intersects with the opening, to the first end 1310 of the cap. The longitudinal split 1340 of the cap allows the constricting of the cap 1300 to maintain the ball and socket joint between the cap 1300 and the spheroid 1400 (FIG. 6) in a locked position. In certain embodiments a draw latch 1600 is interconnected to the cap 1300 wherein a first portion of the draw latch 1600 is interconnected to the cap on a first side of the longitudinal split 1340, and a second portion of the draw latch 1600' is interconnected to the cap on a second side of the longitudinal split 1340. Fastening the portions of the draw latch 1600 and engaging the draw latch 1600 serve to draw the first side of the longitudinal split 1340 toward the second side of the longitudinal split thereby reducing the width 1350 of the longitudinal split and constricting the cap inward. Constricting the cap inward serves to constrain the spheroid 1400 to the cap in a static position. It will be appreciated that the longitudinal split 1340 in the cap is one method of constraining the ball and socket joint mating of the cap and spheroid. It will be further appreciated that alternate methods of constraint between a ball and socket known to one skilled in the art intended to limit the movement of the spheroid in relation to the cap when in a locked configuration are within the spirit and scope of the present invention.

In certain embodiments, referencing FIG. 6, the constraint of the spheroid 1400 to a desired position is accomplished through the use of axial lock 1650 which is axially advanceable toward the spheroid 1400 once it has been configured as desired, thereby compressing the spheroid 1400 between the axial lock 1650 and the hemispherical shaped internal surface 1330 of the cap to provide a frictional hold. The axial lock 1650 comprises a concave hemispherical surface 1660 configured to receive an aspect of the spheroid therein to increase mating surface between the axial lock and the spheroid. It will be appreciated by those skilled in the art, that increased compression of the spheroid results in increased friction, and thereby increases the frictional hold of the spheroid between the axial lock and the internal hemispherical surface of the cap.

Certain embodiments, as shown in FIG. 6, comprise an adaptor insert 1700 wherein the adaptor insert 1700 is configured to be inserted within the first end 1110 of the sleeve wherein the adaptor insert allows for the adjustable grip system to be interconnected with varying diameter pole shafts. The adaptor insert comprises a key 1710 configured to mate with a key 1720 (FIG. 1C) within the first end of the sleeve to assist in alignment.

Figure 9A:
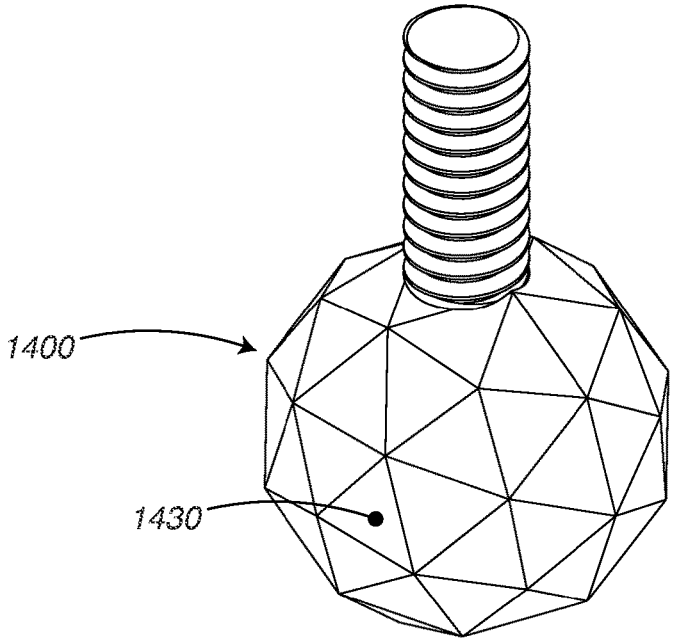
Figure 9B:
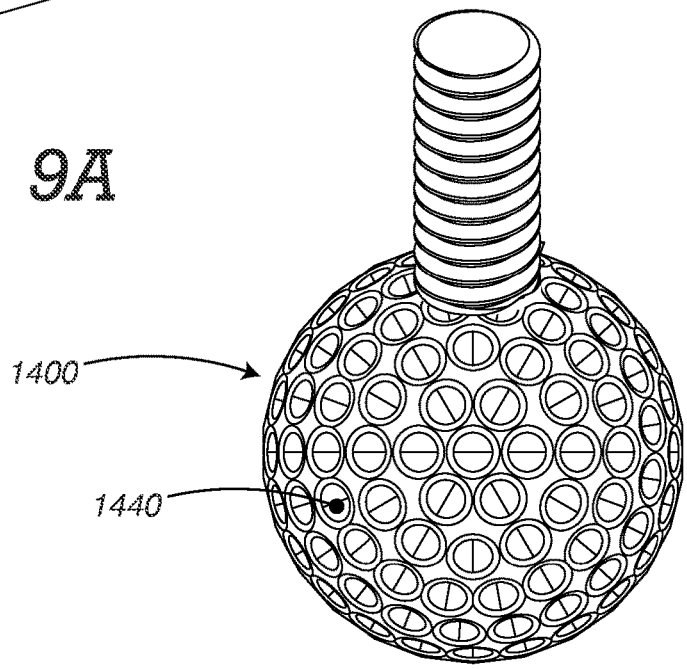

Certain embodiments, as shown in FIG. 9A-FIG. 9B, comprise a spheroid 1400 which comprise constraining features which allow for increased constraint between the cap and spheroid when placed in a locked configuration. Certain embodiments comprise a spheroid having a surface with a plurality of facets 1430, certain embodiments comprise a spheroid 1400 comprising a surface with a plurality of dimples 1440, and certain embodiments comprise a cap having at least one pin or detent extending radially inward from the internal surface of the cap wherein the at least one pin or detent is configured to contact the surface of the spheroid on a faceted face or within a dimple when advanced inward from the internal surface of the cap.

Figure 10A:
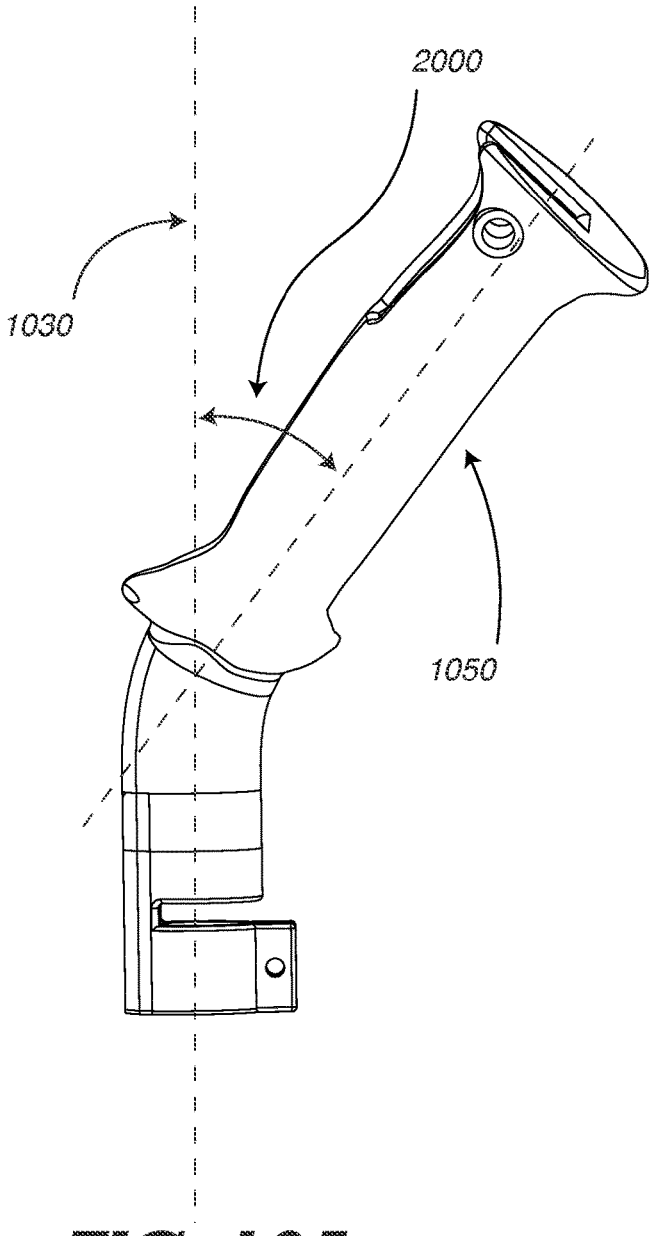
Figure 10B:
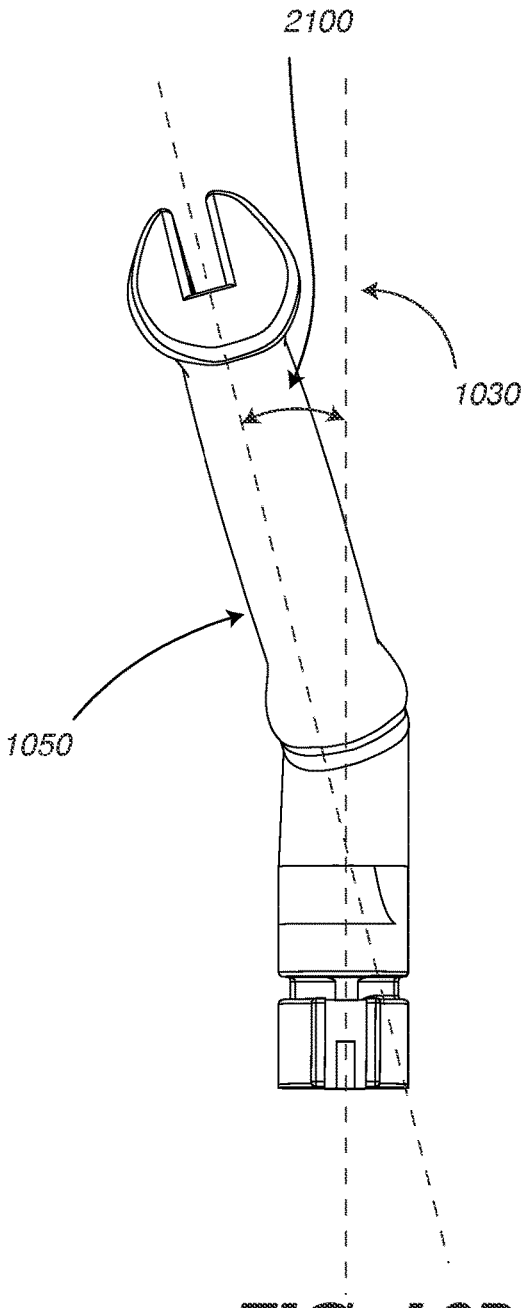
Figure 11C:
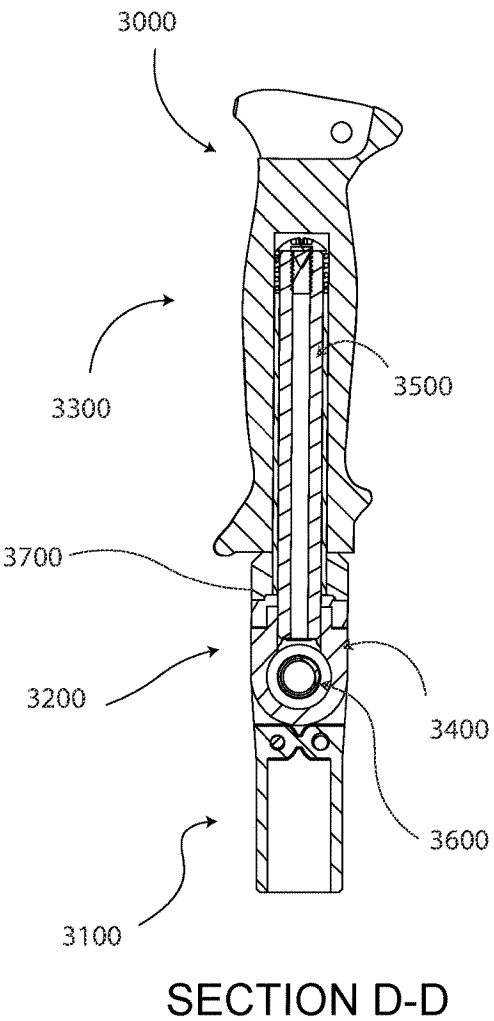
Figure 11B:
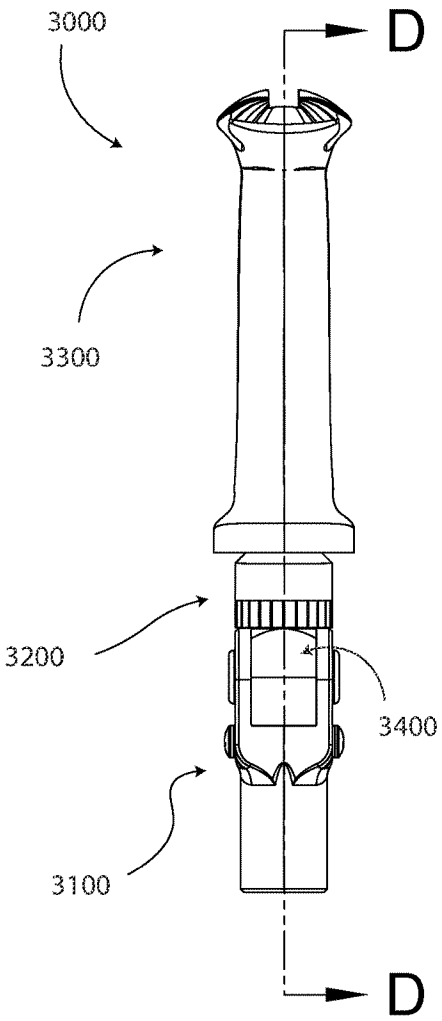
Figure 11A:
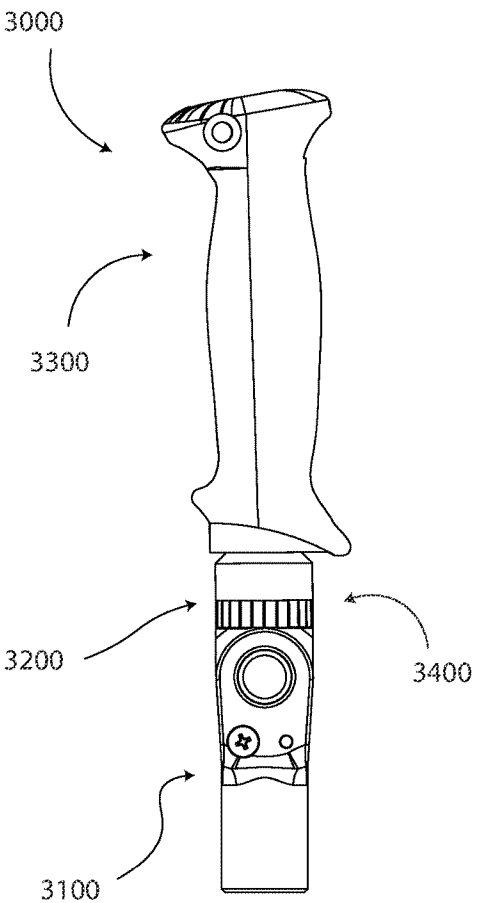
Figure 12A:
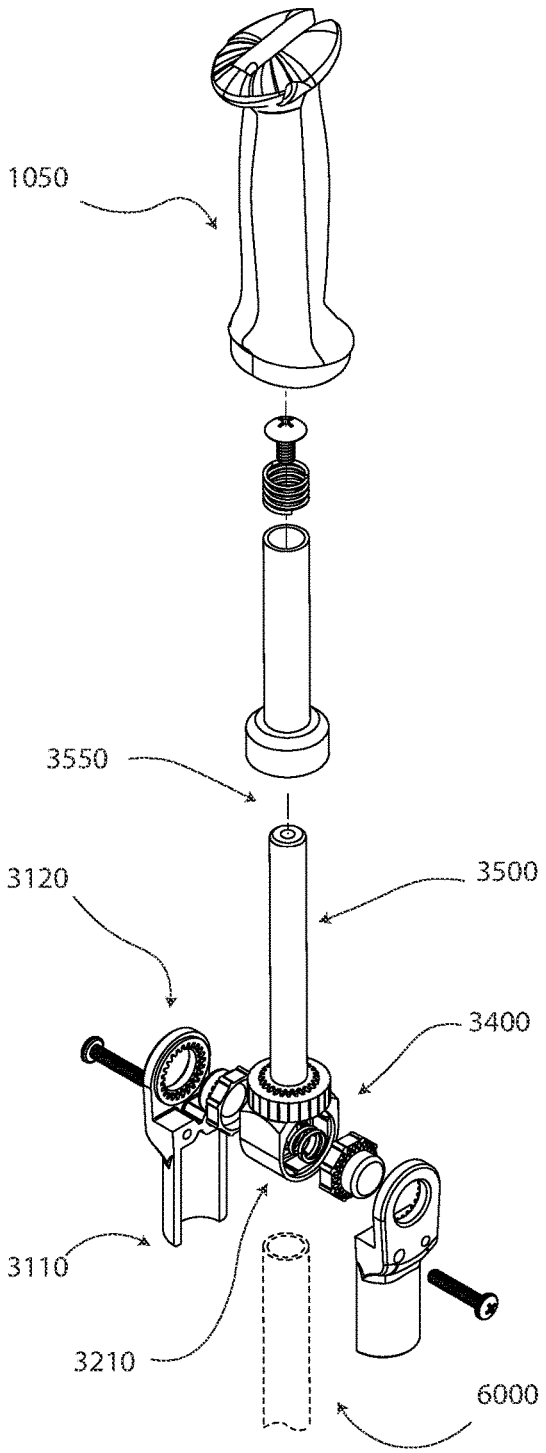
FIG. 12B— An exploded perspective view of certain embodiments of the present invention
Figure 12B:
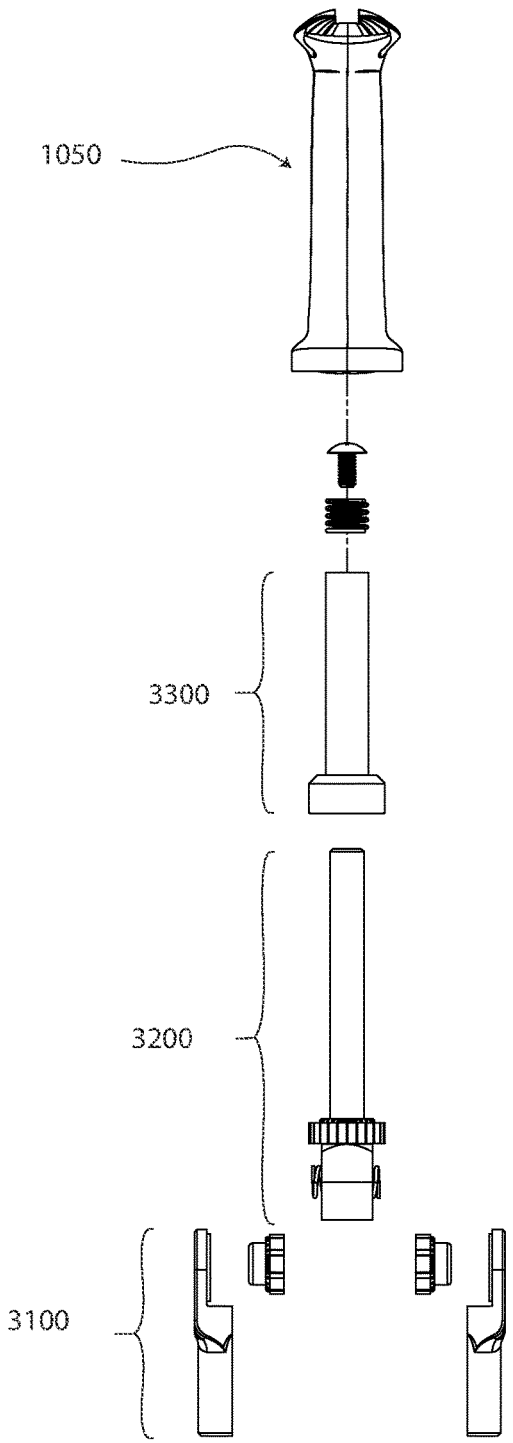
Figure 13A:
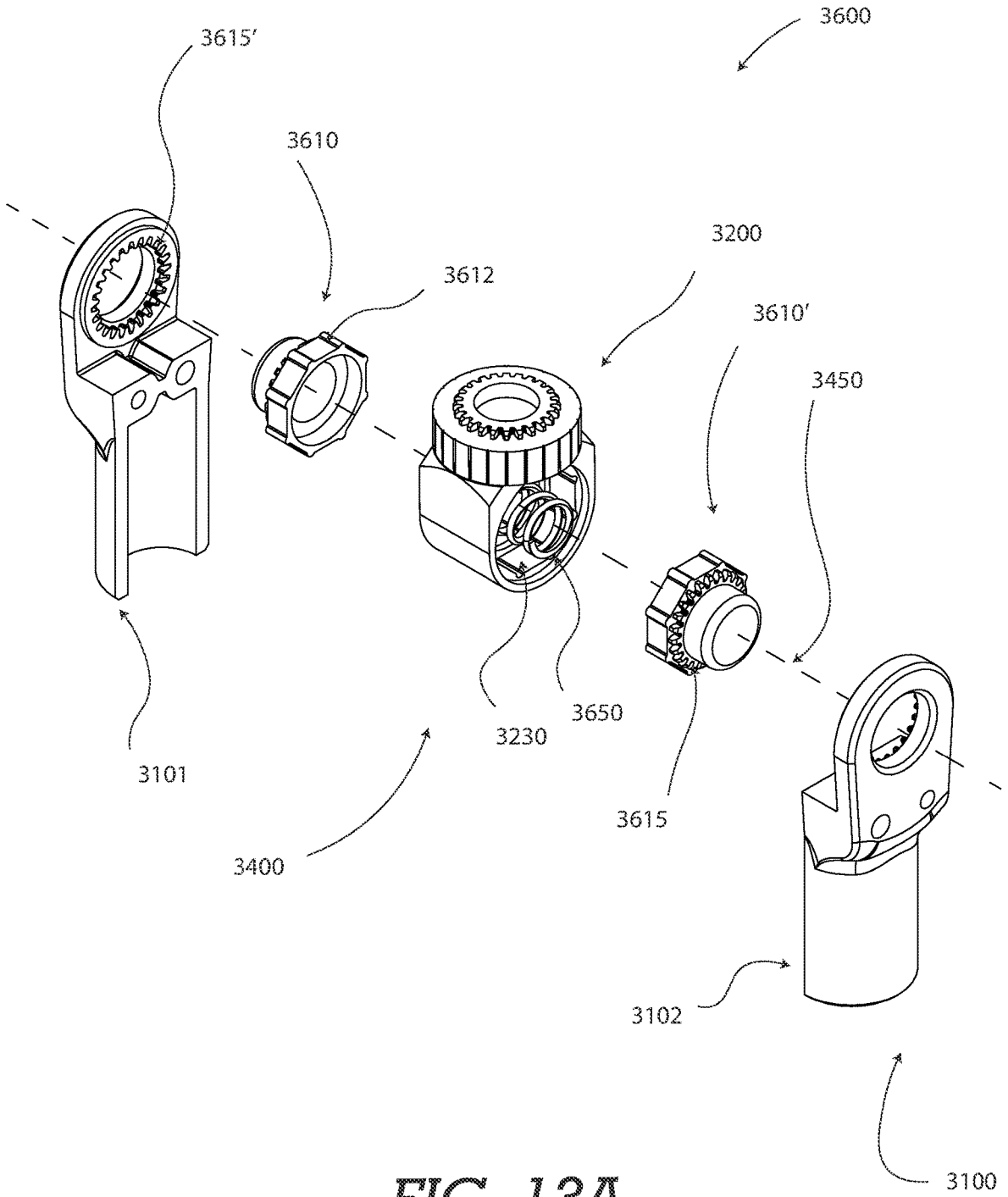
FIG. 13A— An exploded perspective view of certain embodiments of the present invention FIG. 13B—A side view of certain embodiments of the present invention FIG. 13C—A front section-view of certain embodiments of the present invention as shown in FIG. 13B with a first locking mechanism in a locked configuration FIG. 13D—A front section-view of certain embodiments of the present invention as shown in FIG. 13B with a first locking mechanism in an unlocked configuration FIG. 14A—A front view of certain embodiments of the present invention with a second locking mechanism in an unlocked configuration FIG. 14B—A side section-view of certain embodiments of the present invention as shown in FIG. 14A FIG. 14C—A perspective view of certain embodiments of the present invention with a second locking mechanism in an unlocked configuration FIG. 14D—A perspective view of certain embodiments of the present invention with a second locking mechanism in an unlocked configuration FIG. 14E—A perspective view of certain embodiments of the present invention with a second locking mechanism in a locked configuration FIG. 14F—A side section-view of certain embodiments of the present invention as shown in FIG. 14E
Figure 13D:
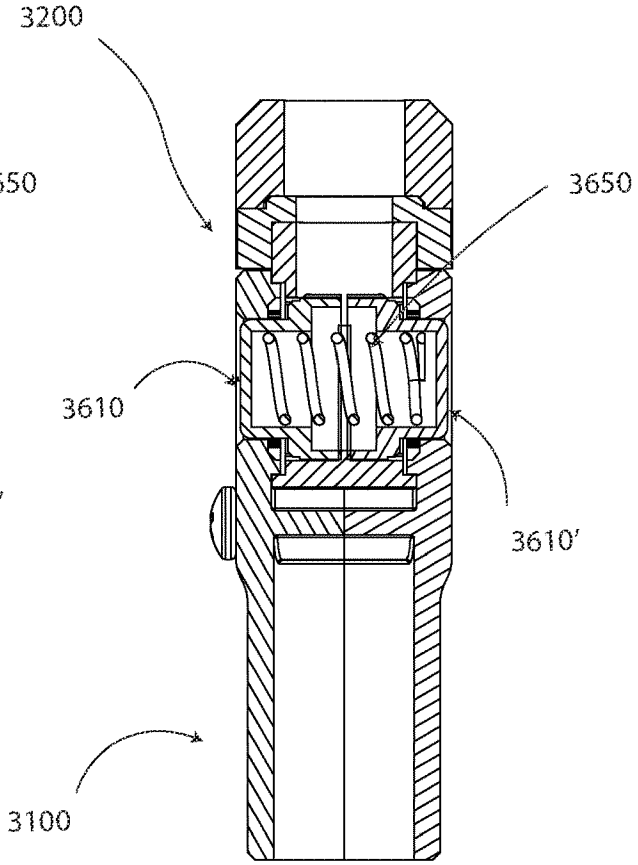
Figure 13C:
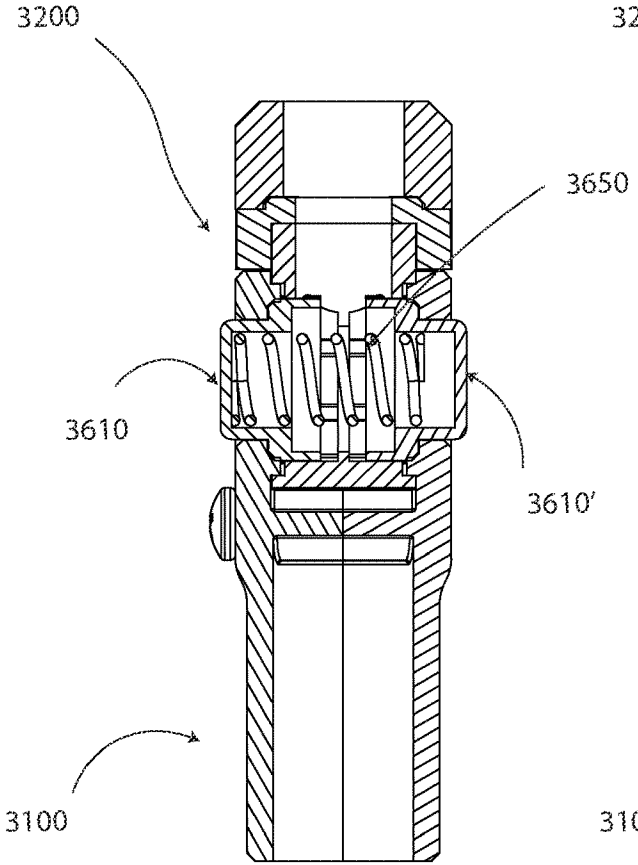
Figure 13B:
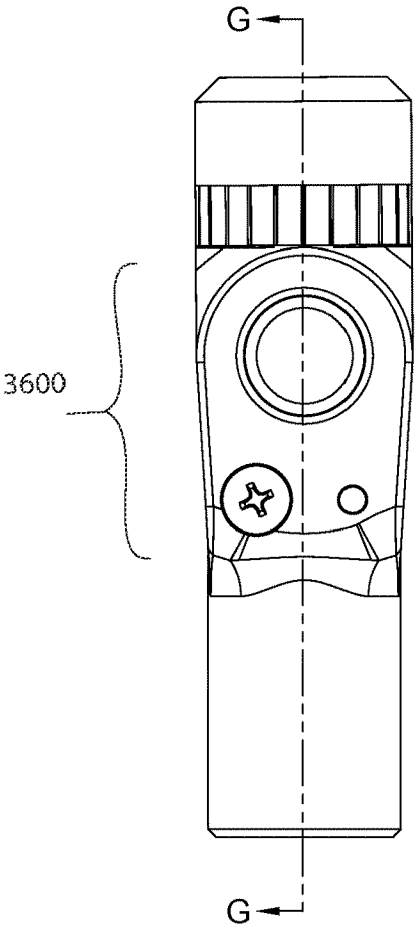
Figures 14A, 14B, 14C, 14D:
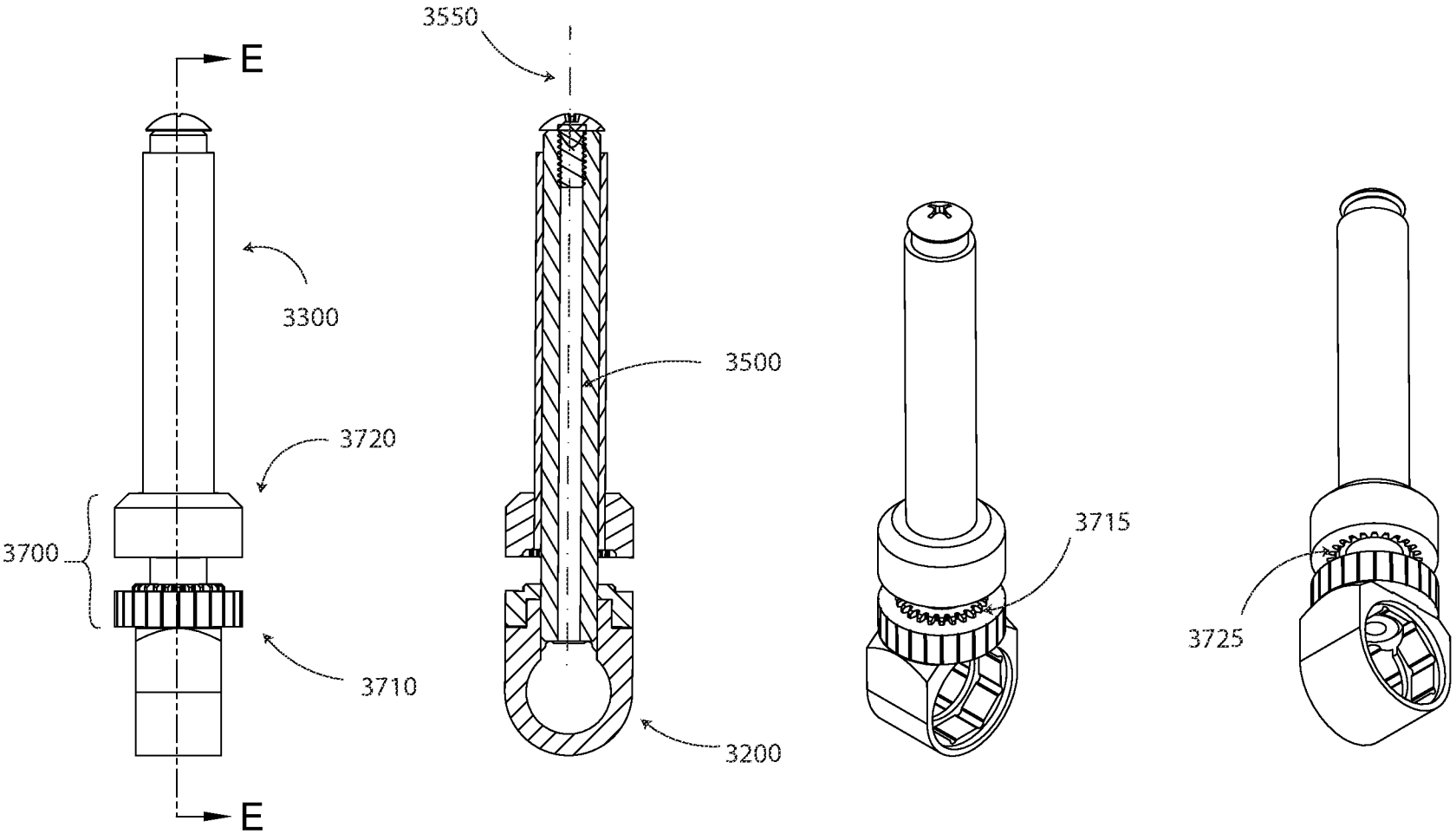
Figure 14E:
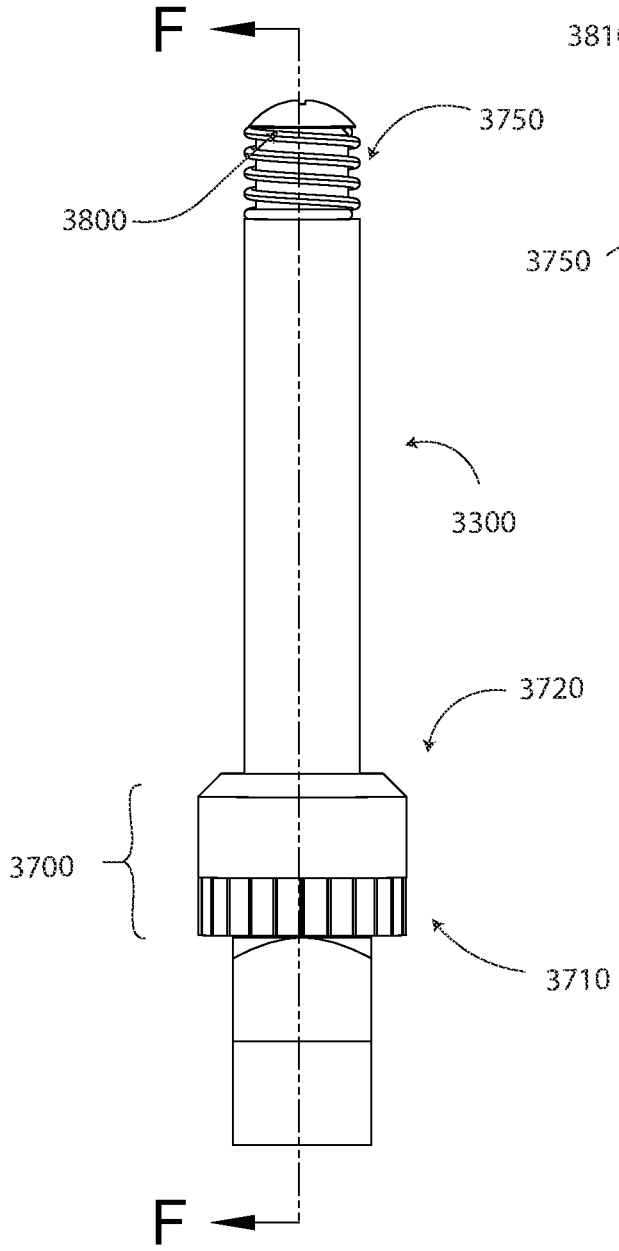
Figure 14F:
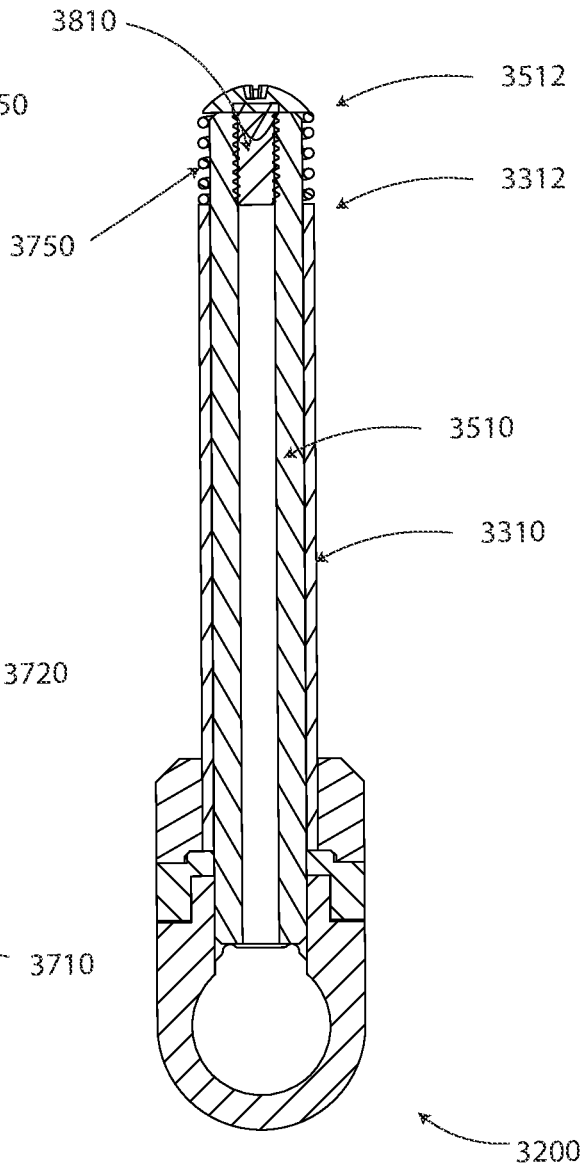

In certain embodiments, as shown in FIG. 10A-FIG. 10B, a grip system 1000 comprises a handle which has been affixed in place with a grip having a pitch forward 2000 away from the longitudinal axis 1030 and a pitch inward 2100 from the longitudinal axis 1030. In certain embodiments the grip has a forward pitch 2000 of 15 degrees forward and an inward pitch 2010 of 5 degrees inward toward a user. In alternative embodiments, the grip has a forward pitch 2000 of 20 degrees forward and an inward pitch 2010 of 10 degrees inward toward the user. It will be appreciated that alternate embodiments having a forward pitch and inward pitch of angles between 0 and 90 degrees are within the spirit and scope of the present invention.

In certain embodiments of the present invention, as shown in FIG. 11A-FIG. 12B for example, an adjustable grip system 3000 comprises a first portion 3100 having a first end 3110 configured to receive a shaft 6000 of a trekking pole therein. A second end 3120 of the first portion is interconnected with a first end 3210 of a second portion at a joint 3400. The joint 3400 is configured to permit the rotation of the second portion 3200 in relation to the first portion 3100 about a first axis 3450. The second portion 3200 further comprises an axial member 3500 extending away from the joint 3400. A longitudinal axis of the axial member provides a second axis 3550 of the adjustable grip system. A third portion 3300 is slidably interconnected with the second portion 3200 wherein the third portion 3300 is configured to slide longitudinally along the axial member 3500, and wherein the third portion 3300 is configured to rotate about the second axis 3550. The third portion 3300 is configured to interconnect with a grip 1050 to provide a gripping surface for a user. Although embodiments shown herein demonstrate a grip 1050 and a third portion 3300 as separate elements, alternate embodiments wherein the grip 1050 and third portion 3300 are a unitary element are within the spirit and scope of the present invention.

In certain embodiments, as shown in FIG. 13 for example, an adjustable grip system comprises a first locking mechanism 3600 configured to constrain the movement of the joint 3400, thus constraining the rotational movement of the second portion 3200 in relation to the first portion 3100. The first locking mechanism 3600 of certain embodiments comprises at least a first button 3610 wherein depressing the first button 3610 unlocks the joint 3400 and allows a user to rotate the second portion 3200 in relation to the first portion 3100. In certain embodiments the first portion comprises a clevis form, and in certain embodiments the first portion comprises a first half 3101 and a second half 3102. The first button 3610 of certain embodiments is coincident with the first axis 3450, while in further embodiments, the first button 3610 is coaxial with the first axis 3450. Certain embodiments of the first locking mechanism 3600 comprises a spring 3650, such as a compressive spring, configured to force the first button 3610 laterally outward from the joint 3400. Forcing the first button 3610 away from the joint 3400 causes the first locking mechanism 3600 to lock the joint 3400 and constrain the rotational motion of the second portion 3200 in relation to the first portion 3100.

In certain embodiments, a first button 3610 for unlocking the first locking mechanism 3600 comprises a medial 3612 aspect which is keyed to the second portion 3200 of the adjustable grip system, and further comprises a lateral aspect 3614 which is keyed to the first portion 3610 of the adjustable grip system. When the first button 3610 is depressed, the lateral aspect 3614 disengages from the first portion 3100 while the medial aspect 3612 remains engaged with the second portion 3200, thereby allowing the rotation of the second portion 3200 in relation to the first portion 3100. When the first button 3610 is released and forced laterally outward, the lateral aspect 3614 of the first button re-engages with the first portion 3100 and thereby constrains once again the rotation of the first portion 3100 in relation to the second portion 3200. Embodiments as shown comprise a lateral portion 3614 having a plurality of protuberances 3615 and the first portion having a plurality of protuberances 3615' configured to intermesh—similarly to a first face gear intermeshing with a second face gear wherein the protuberances 3615' of the first portion and the protuberances 3615 of the button are configured to interdigitate with each other. However, alternate keyed solutions which provide mechanical constraint between the button 3610 and the first portion 3100, including key and slot configurations, are within the spirit and scope of the present invention. Furthermore, embodiments as shown comprise a medial portion 3612 having a polygonal form wherein the interior aspect 3230 of the second portion comprises a similarly shaped polygonal form configured to receive the medial aspect 3612. However, alternate keyed solutions which provide mechanical constraint between the first button 3610 and the second portion 3200 when engaged, including key and slot configurations, are within the spirit and scope of the present invention.

Certain embodiments of the present invention comprise a first button 3610 and a second button 3610' axially opposed to each other wherein the depressing of the first button 3610 and the second button 3610' medially inward results in the unlocking of the first locking mechanism 3600 and thereby allows the rotational movement of the second portion 3200 in relation to the first portion 3100. Similarly, when the first button 3610 and second buttons 3610' are released, the buttons are forced outward by the spring 3650, thus locking the first locking mechanism 3600 and constraining the rotational motion between the second portion 3200 and the first portion 3100.

Certain embodiments of the present invention, as shown in FIG. 14A-FIG. 14F for instance, comprise a second locking mechanism 3700 configured to constrain the third portion 3300 from axially rotating about the second axis 3550 in relation to the second portion 3200. The second locking mechanism 3700 of certain embodiments comprises a first keyed element 3710 interconnected with the second portion 3200, wherein the first keyed element 3710 is unable to rotate in relation to the second portion 3200, and a second keyed element 3720 interconnected with the third portion 3300 wherein the second keyed element 3720 is unable to rotate in relation to the third portion 3300. The first keyed element 3710 and the second keyed element 3720 are configured and keyed to intermesh with each other such that when they are forced together, the first keyed element 3710 and second keyed element 3720 are unable to rotate in relation to each other. Forcing the third portion 3300 slidably toward the second portion 3200 along the axial member 3500 engages the first keyed element 3710 with the second keyed element 3720, thereby intermeshing the first keyed element 3710 with the second keyed element 3720 and constraining the rotation of the third portion 3300 in relation to the second portion 3200. Thus, forcing the third portion 3300 toward the second portion 3200 locks second locking mechanism 3700 and constrains the rotation of the third portion 3300 in relation to the second portion 3200. As shown, the first keyed element 3710 comprises protuberances 3715 configured to intermesh with protuberances 3725 of the second keyed element, similarly to the intermeshing of a first face gear and a second face gear wherein the protuberances 3715 of the second portion and the protuberances 3725 of the third portion are configured to interdigitate with each other. However, alternate embodiments wherein the first keyed element 3710 and the second keyed element 3720 comprise a key and slot or other elements configurated to intermesh to limit rotational movement of the third portion in relation to the second portion are within the spirit and scope of the present invention.

In certain embodiments the keyed elements of the second locking mechanism 3700 comprise a first collar 3711 and a second collar 3722 keyed to each other wherein the intermeshing of the keyed elements constrains the rotational movement of the third portion 3300 in relation to the second portion 3200. In certain embodiments the keyed elements allow intermeshing on a plurality of angular intervals. In certain embodiments, the first keyed element 3710 and the second keyed element 3720 can be intermeshed on intervals of 12-degrees for a full 360-degree rotational range. Although certain angular intervals 3730 are shown and discussed herein, alternate intervals of intermeshing between the first keyed element and the second keyed element are considered within the spirit and scope of the present invention.

In certain embodiments, a spring 3750 is configured to force the third portion 3300 toward the second portion 3200, thereby the second locking mechanism is configured to be locked unless the third portion 3300 is pulled away from the second portion 3200 to disengage the keyed elements 3710, 3720 away from each other.

In certain embodiments, the axial member 3500 of the second portion comprises a shaft 3510, and the third portion 3300 comprises a sleeve 3310 configured to axially receive the shaft of the second portion therein, wherein a distal end 3512 of the axial member extends beyond the distal end 3312 of the sleeve. A mechanical stop 3800, which comprises a screw 3810 interconnected to the distal end 3512 of the axial member in certain embodiments, allows for a spring 3750 to be disposed between the distal end 3512 of the axial member and the distal end 3312 of the sleeve wherein the compressive spring 3750 bears on the mechanical stop 3800 to force the third portion 3300 toward the second portion to intermesh the keyed elements 3710, 3720.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. An adjustable grip system for use with a trekking pole comprising:

a first portion having a first end configured to interconnect with a shaft, and a second end of the first portion interconnected with a first end of a second portion at a joint, wherein the joint is configured to permit the rotation of the second portion in relation to the first portion about a first axis;

the second portion further comprises an axial member extending away from the joint;

a second axis coaxial with the axial member;

a third portion configured to interconnect with a grip;

the third portion is interconnected with the axial member wherein the third portion is configured to slide longitudinally along the axial member, and wherein the third portion is configured to rotate about the second axis.

2. The adjustable grip system of claim 1, further comprising a first locking mechanism at the interconnection between the first portion and the second portion, wherein the first locking mechanism is configured to constrain the second portion from rotating in relation to the first portion when the first locking mechanism is locked.

3. The adjustable grip system of claim 2, wherein the first locking mechanism comprises a button on a first side of the joint, wherein the button is coincident with the first axis, and wherein depressing the button toward the joint unlocks the first locking mechanism thereby permitting the rotation of the second portion in relation to the first.

4. The adjustable grip system of claim 3, wherein the first locking mechanism further comprises a spring configured to force the first button away from the joint.

5. The adjustable grip system of claim 4, wherein the first button comprises a medial aspect keyed to the second portion such that the first button rotates with the second portion; and the first button further comprises a lateral aspect keyed to the first portion, wherein when the button is depressed the lateral aspect disengages from the first portion, thereby unlocking the first locking mechanism, and thereby allowing the rotation of the second portion in relation to the first portion, and wherein when the button is released the lateral aspect engages with the first portion thereby locking the first locking mechanism and thereby constraining the second portion from rotating in relation to the first portion.

6. The adjustable grip system of claim 4, further comprising a second button axially opposite from the first button;

the buttons each comprising a medial aspect keyed to the second portion and a lateral aspect keyed to the first portion, wherein when the buttons are depressed the lateral aspects disengage from the first portion, thereby unlocking the first locking mechanism, and thereby allowing the rotation of the second portion in relation to the first portion, and wherein when the buttons are released the lateral aspects engage with the first portion thereby locking the first locking mechanism and thereby constraining the second portion from rotating in relation to the first portion.

7. The adjustable grip system of claim 6, wherein the first locking mechanism is configured to lock the second portion in relation to the first portion in a plurality of angles.

8. The adjustable grip system of claim 6, further comprising a second locking mechanism at the interconnection between the second portion and the third portion, wherein the second locking mechanism is configured to constrain the third portion from rotating in relation to the second portion when the second locking mechanism is locked.

9. The adjustable grip system of claim 8, wherein forcing the third portion toward the joint locks the second locking mechanism, thereby constraining the third portion from rotating in relation to the second portion.

10. The adjustable grip system of claim 8, further comprising spring configured to force the third portion slidably toward the joint.

11. The adjustable grip system of claim 10, wherein the second locking mechanism further comprises:

a first keyed element interconnected with the second portion and a second keyed element interconnected with the third portion, wherein the keyed elements are configured to constrain rotation of the third portion in relation to the second portion when the keyed elements are intermeshed.

12. The adjustable grip system of claim 11, wherein the second locking mechanism is configured to lock the third portion in relation to the second portion in a plurality of angles.

13. The adjustable grip system of claim 2, further comprising a second locking mechanism at the interconnection between the second portion and the third portion, wherein the second locking mechanism is configured to constrain the third portion from rotating in relation to the second portion when the second locking mechanism is locked.

14. The adjustable grip system of claim 13, wherein forcing the third portion toward the joint locks the second locking mechanism, thereby constraining the third portion from rotating in relation to the second portion.

15. The adjustable grip system of claim 13, further comprising spring configured to force the third portion slidably toward the joint.

16. The adjustable grip system of claim 15, wherein the second locking mechanism further comprises:

a first keyed element interconnected with the second portion and a second keyed element interconnected with the third portion, wherein the keyed elements are configured to constrain rotation of the third portion in relation to the second portion when the keyed elements are intermeshed.

17. The adjustable grip system of claim 16, wherein the second locking mechanism is configured to lock the third portion in relation to the second portion in a plurality of angles.

18. An adjustable grip system for use with a trekking pole comprising:

a first portion having a first end configured to receive a shaft therein, and a second end of the first portion interconnected with a first end of a second portion at a joint, wherein the joint is configured to permit the rotation of the second portion in relation to the first portion about a first axis;

a first locking mechanism configured to constrain the rotation of the second portion in relation to the second portion;

the first locking mechanism comprising a first button and a second button, wherein depressing the buttons disengages the first locking mechanism thereby allowing the rotation of the second portion in relation to the first portion, and wherein forcing the buttons laterally outward engages the first locking mechanism, thereby constraining the rotation of the second portion in relation to the first portion;

a first compressive spring configured to axially force the buttons laterally outward;

the second portion further comprises an axial member extending away from the first end of the second portion;

a third portion comprising a grip;

the third portion is interconnected with the axial member wherein the third portion is configured to slide longitudinally along the axial member, and wherein the third portion is configured to rotate about a second longitudinal axis of the axial member;

a second locking mechanism configured to constrain the rotation of the third portion in relation to the second portion when the third portion is longitudinally forced toward the joint; and a second compressive spring configured to force the third portion slidably toward the joint.

19. A method for adjusting the adjustable grip system of claim 18 comprising:

depressing the buttons axially inward toward the joint, thereby compressing the first compressive spring and disengaging the first locking mechanism;

adjusting the second portion rotatively in relation to the first portion;

releasing the buttons, thereby allowing the first compressive spring to force the buttons laterally outward and thereby reengaging the first locking mechanism;

slidably displacing the third portion axially away from the joint, thereby disengaging the second locking mechanism, and compressing the second compressive spring;

adjusting the third portion rotatively in relation to the second portion;

releasing the third portion thereby allowing the second compressive spring to force the third portion toward the joint and thereby reengaging the second locking mechanism.

* * * * *